US005147142A

United States Patent [19]

Shibazaki et al.

[11] Patent Number: 5,147,142

[45] Date of Patent: Sep. 15, 1992

[54] IMPACT TYPE RECORDING APPARTUS HAVING REDUCED IMPACT SOUND DURING RETURN OF THE HAMMER

[75] Inventors: Nobuo Shibazaki, Tokyo; Tetsuya Saito, Yokohama, both of Japan

[73] Assignee: Canon Kabushiki Kaisha, Tokyo, Japan

[21] Appl. No.: 588,481

[22] Filed: Sep. 25, 1990

Related U.S. Application Data

[63] Continuation of Ser. No. 418,828, Oct. 4, 1989, abandoned, which is a continuation of Ser. No. 94,894, Sep. 10, 1987, abandoned.

[30] Foreign Application Priority Data

Sep. 16, 1986 [JP] Japan ..... 61-216051
Sep. 25, 1986 [JP] Japan ..... 61-224906

[51] Int. Cl.[5] ..... B41J 9/42

[52] U.S. Cl. ..... 400/167; 400/157.3; 101/43.02

[58] Field of Search ..... 400/166, 167, 157.2, 400/157.3; 101/93.02, 93.03

[56] References Cited

U.S. PATENT DOCUMENTS 4,192,230 3/1980 Blom ..... 101/93.03
4,407,193 10/1983 Hall ..... 101/93.03 X
4,538,930 9/1985 Dunfield ..... 400/144.2
4,547,087 10/1985 Heider ..... 400/167 X
4,569,607 2/1986 Takemoto ..... 400/167
4,744,684 5/1988 Maekawa ..... 400/167

FOREIGN PATENT DOCUMENTS 0116850 8/1984 European Pat. Off. ..... 400/157.2
173677 10/1983 Japan ..... 400/157.2
222866 12/1983 Japan ..... 400/157.2

*Primary Examiner*—David A. Wiecking
*Assistant Examiner*—Steven S. Kelley
*Attorney, Agent, or Firm*—Fitzpatrick, Cella, Harper & Scinto

[57] ABSTRACT

An impact type recording apparatus includes a platen for supporting a recording medium, a hammer guided for reciprocal movement between an impacting position in which it strikes against the platen and a retracted position spaced apart from the platen, energizing means producing a force for biasing the hammer from the retracted position toward the impacting position, means for detecting the position of the hammer to thereby detect the speed of the hammer, and drive control means for operating the energizing means with only one pulse to brake the hammer when the hammer is moved from the impacting position to the retracted position, and making the operation timing of the braking pulse variable in conformity with the result of the detection by the detecting means.

43 Claims, 12 Drawing Sheets

IMPACT TYPE RECORDING APPARTUS HAVING REDUCED IMPACT SOUND DURING RETURN OF THE HAMMER

This application is a continuation of application Ser. No. 07/418,828 filed, Oct. 4, 1989, which is a continuation of application Ser. No. 07/-094,894 filed Sept. 10, 1987, both now abandoned.

BACKGROUND OF THE INVENTION

1. Field of the Invention

The present invention relates to a recording apparatus, and in particular to an impact type recording apparatus which effects recording by the impact force of a recording hammer.

2. Related Background Art

In the field of a recording apparatus for a computer system or an electronic typewriter, there is generally known a so-called impact type recording apparatus such as a daisy wheel printer. The recording apparatus of this type is designed chiefly such that a hammer or the like is driven by a magnetic force produced when electric power is supplied to a solenoid, and impacts characters to thereby accomplish printing, and such recording apparatus has the merit that printing of high quality can be obtained, while it has the demerit that the noise during printing is great. One of the causes of the noise is the impact sound produced when the hammer returns to its standby position and strikes against a stopper after printing. A method of reducing such noise is to supply electric power to the solenoid when the hammer returns to a predetermined position, and reduce the return speed thereof to thereby reduce the sound of impact against the stopper.

Generally, however, the areas of the characters included in the character wheel differ from one another and the printing energy necessary for printing also differs from character to character and therefore, the power supply time or the energizing current value of a coil unit for driving the hammer is controlled to thereby control the kinetic energy imparted to the hammer. For example, control is effected such that the hammer speed when printing a character of large printing area such as "M" is fast and the hammer speed when printing a symbol of small printing area such as "." is slow.

Therefore, in situations where an attempt is made to decelerate the printing hammer by the aforedescribed method and the energization timing is set so that as shown in FIG. 7A of the accompanying drawings, the deceleration is completed the hammer returns to the stopper. The deceleration corresponds to a curve 60 showing the displacement of the hammer when printing "M". The timing of the energization for deceleration will become too early in the case of a curve 61 which shows the printing of ".", and the brake will act before the hammer returns to the stopper, and thus the hammer will advance toward the platen (the portion indicated by 62). Also, if as shown in FIG. 7B of the accompanying drawings, the energization timing is set correspondingly to a curve 63 which shows the printing of ".", when the character "M" is printed, the hammer strikes against the stopper at 65 before it is decelerated as indicated by a curve 64, and thus a sufficient effect cannot be obtained.

SUMMARY OF THE INVENTION

It is an object of the present invention to provide an impact type recording apparatus in which the impact sound during the return of hammer means is reduced.

Other objects of the present invention will become apparent from the following detailed description of the invention when read in conjunction with the accompanying drawings.

DESCRIPTION OF THE PREFERRED EMBODIMENTS

Some embodiments of the present invention will hereinafter be described in detail with reference to the drawings.

Figure 2:
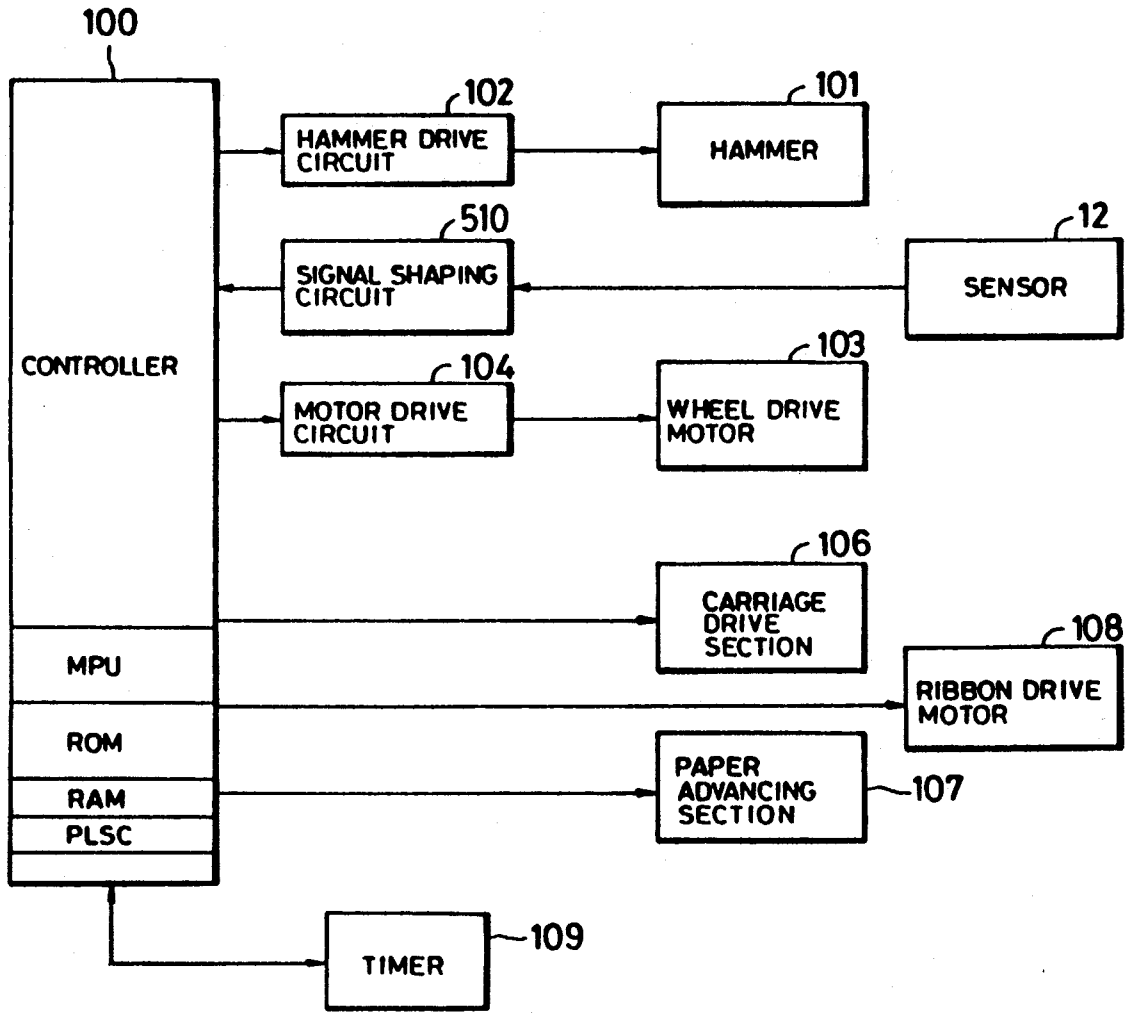
FIG. 2 is a block diagram of the printer according to the present embodiment.

Description of a Printer shown in FIG. 2

FIG. 2 is a schematic block diagram showing the construction of a printer according to an embodiment of the present invention.

In FIG. 2, reference numeral 100 designates a controller for controlling the entire printer. The controller 100 includes an MPU such as a microprocessor, an ROM storing therein the control program, data, etc. of MPU shown in the flow chart of FIG. 6, an RAM as the work area of the MPU, etc. Reference numeral 101 denotes a hammer for impacting a character wheel rotated by a wheel drive motor 103 and effecting printing, and reference numeral 102 designates a hammer drive circuit for driving the hammer 101 by a magnetic force.

Reference numeral 103 denotes a wheel drive motor for rotating the character wheel to select a desired character on the character wheel, and reference numeral 104 designates a motor drive circuit for the wheel drive motor. Reference numeral 12 denotes a sensor for detecting movement of the hammer 101. The sensor 12 is used to detect the position and speed of movement of the hammer 101. The signal from the sensor 12 is shaped by a signal shaping circuit 510 and input as the sensor output signal to the controller. Reference numeral 106 designates a carriage drive section including a carriage drive motor or the like for moving a carriage, and reference numeral 107 denotes a paper advancing section including a paper advancing motor or the like. Reference numeral 108 designates a ribbon drive motor for effecting take-up driving of a printing ribbon, and reference numeral 109 denotes a time for counting time on the basis of the signal from the controller 100.

Description of the Printing Section of the Printer shown in FIGS. 1A–1C and FIG. 37

Figure 1A:
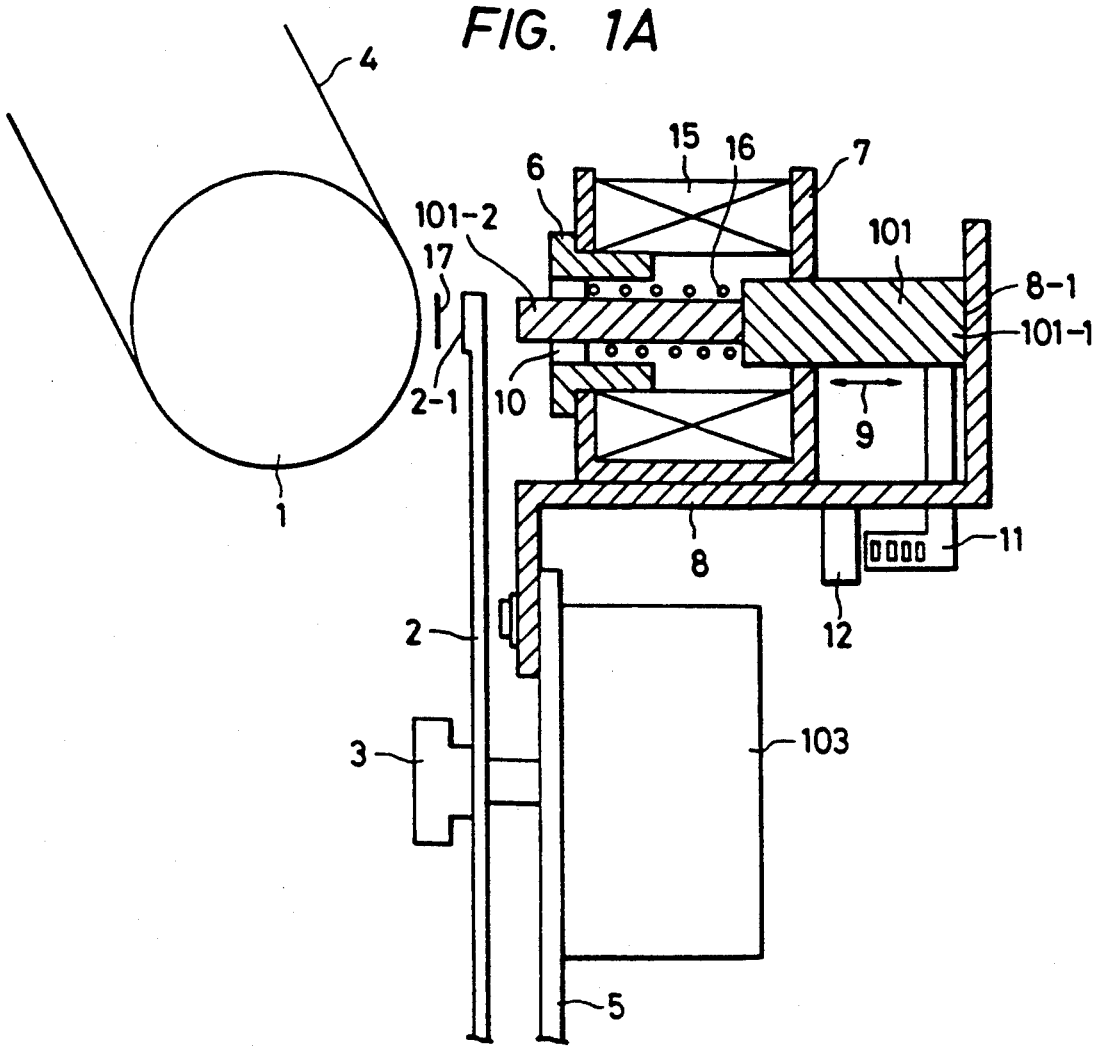
FIG. 1A is a cross-sectional view showing the structure of the printing section of a printer according to an embodiment of the present invention.

FIG. 1A is a cross-sectional view of the printing section of the printer according to the present embodiment.

The hammer 101 comprises an armature 101 - 1 formed of a magnetic material and a tip end portion 101 - 2 formed of a non-magnetic material. The hammer 101 is supported by a bearing 10 and the bearing portion of the support frame 7 of a coil unit 15 and is movable in the direction of arrow 9. The hammer 101 is normally pressed against the stopper 8 - 1 of a hammer base 8 by the force of a compression coil spring 16 and held in a so-called standby position.

The character wheel 2 mounted on the shaft of the wheel drive motor 103 fixed to the carriage 5 is rotated by the wheel drive motor 103, whereby a desired character is selected and carried to between the hammer 101 and a platen 1. Thereafter, when an electric power is supplied to the coil unit 15, the hammer 101 is protruded toward the platen 1 by a magnetic force produced between a yoke 6 and the armature 101 - 1, and impacts a character 2 - 1 against a recording medium 4 on the platen 1 through an ink ribbon 17, thus effecting printing. After the printing, the hammer 101 is retracted backwardly by the reaction force of the compression coil spring 16, and strikes against the stopper 8 - 1, whereby it is stopped and restores the standby position.

Figure 1B:
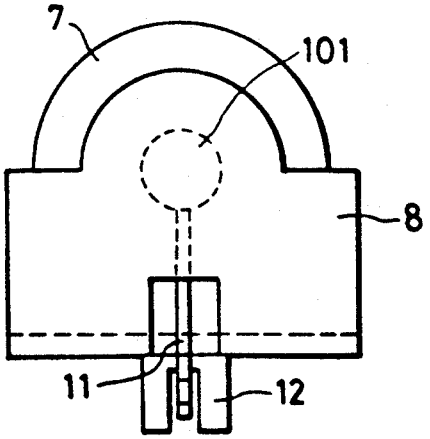
FIG. 1B is a rear view of a hammer.

FIG. 1B shows a portion of the hammer 101 as seen from behind the stopper 8.

Figure 1C:
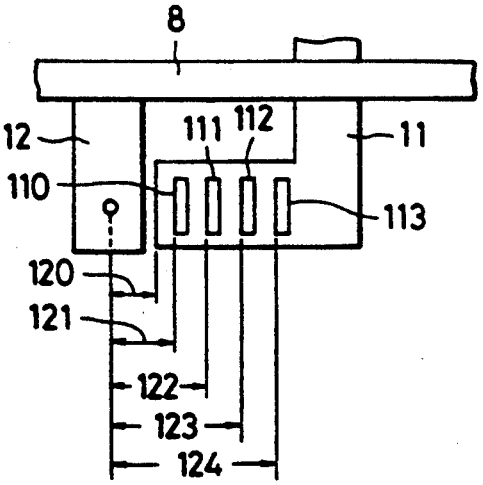
FIG. 1C is an enlarged view of a slit plate and a sensor portion.

As shown in FIG. 1C, a slit plate 11 is attached to the hammer 101 and is moved with movement of the hammer 101. FIG. 1C shows the details of the sensor portion. The slit plate 11 is provided with slits 110–113. The displacement of the respective slits from the sensor 12 in the standby position is indicated at 120–124.

Figure 3:
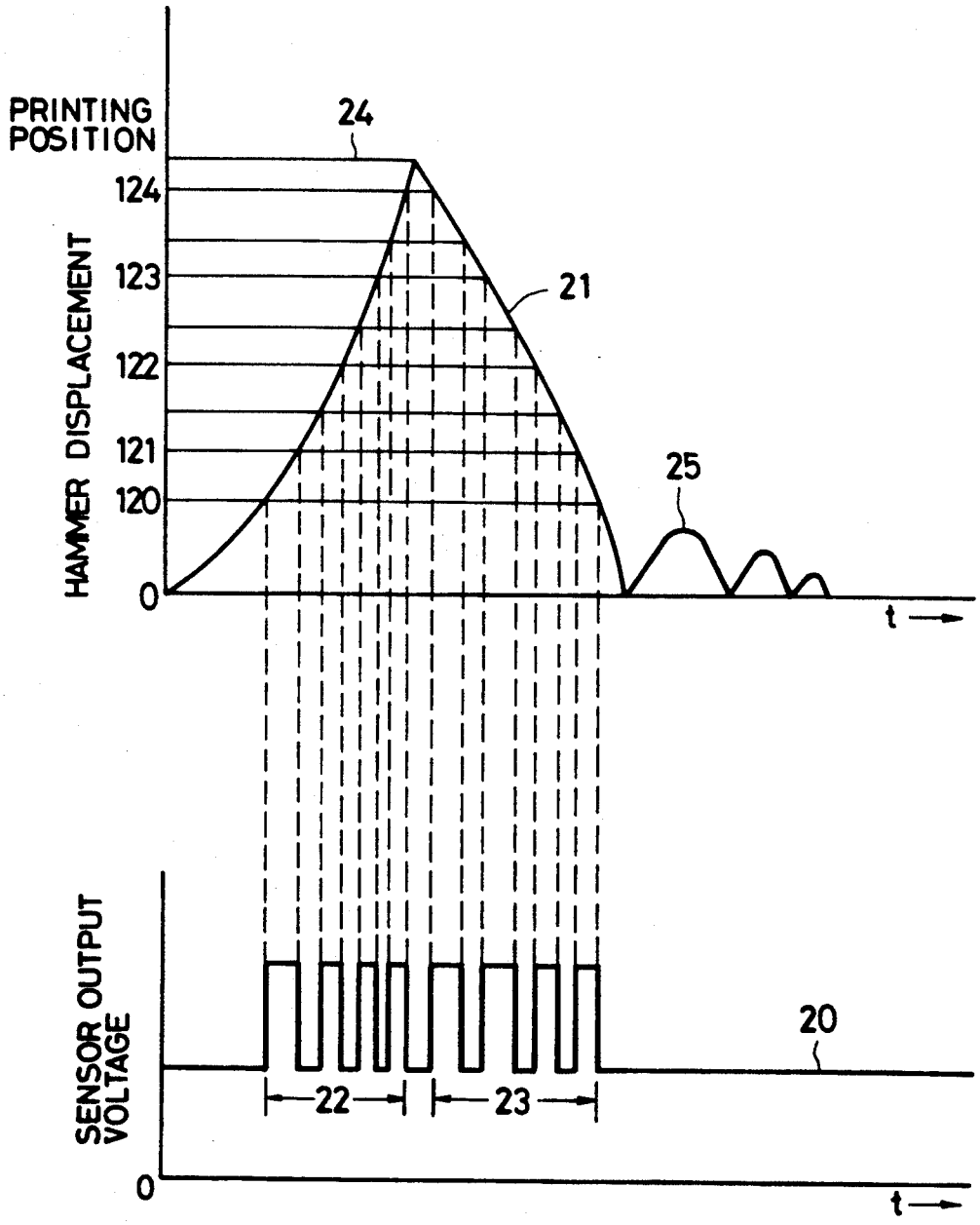
FIG. 3 shows the relation between the displacement of the hammer and the sensor output voltage.

When the hammer 101 is reciprocally moved, a sensor output signal 20 as shown in FIG. 3 is input from the sensor 12 to the controller 100. The curve 21 of FIG. 3 shows the displacement of the hammer 101 for time, i.e., the distance thereof from the stopper 8 - 1. The output signal 20 of the sensor 12 is such a signal that assumes a high level during the light interception by the slit plate 11 and assumes a low level before the slit plate 11 passes or when the slits 110–113 pass.

Designated by 22 is the output signal during the so-called forward movement in which the hammer 101 arrives at the printing position 24 from the standby position, and denoted by 23 is the output signal during the so-called backward movement in which the hammer 101 returns from the printing position to the standby position. Also, designated by 25 is the displacement of the hammer 101 repelled by the stopper 8 - 1 after having struck against the stopper 8 - 1.

The width of and the spacing between the slits 110–113 are constant and therefore, if the time interval of the pulses of the sensor output signal 20 is read, the average speed of the hammer 101 during the meantime can be detected. Also, if the positional relations among the stopper 8 - 1, the sensor 12 and the slits 110–113 are predetermined, the position of the hammer 101 relative to the stopper 8 - 1 can be detected.

Figure 4:
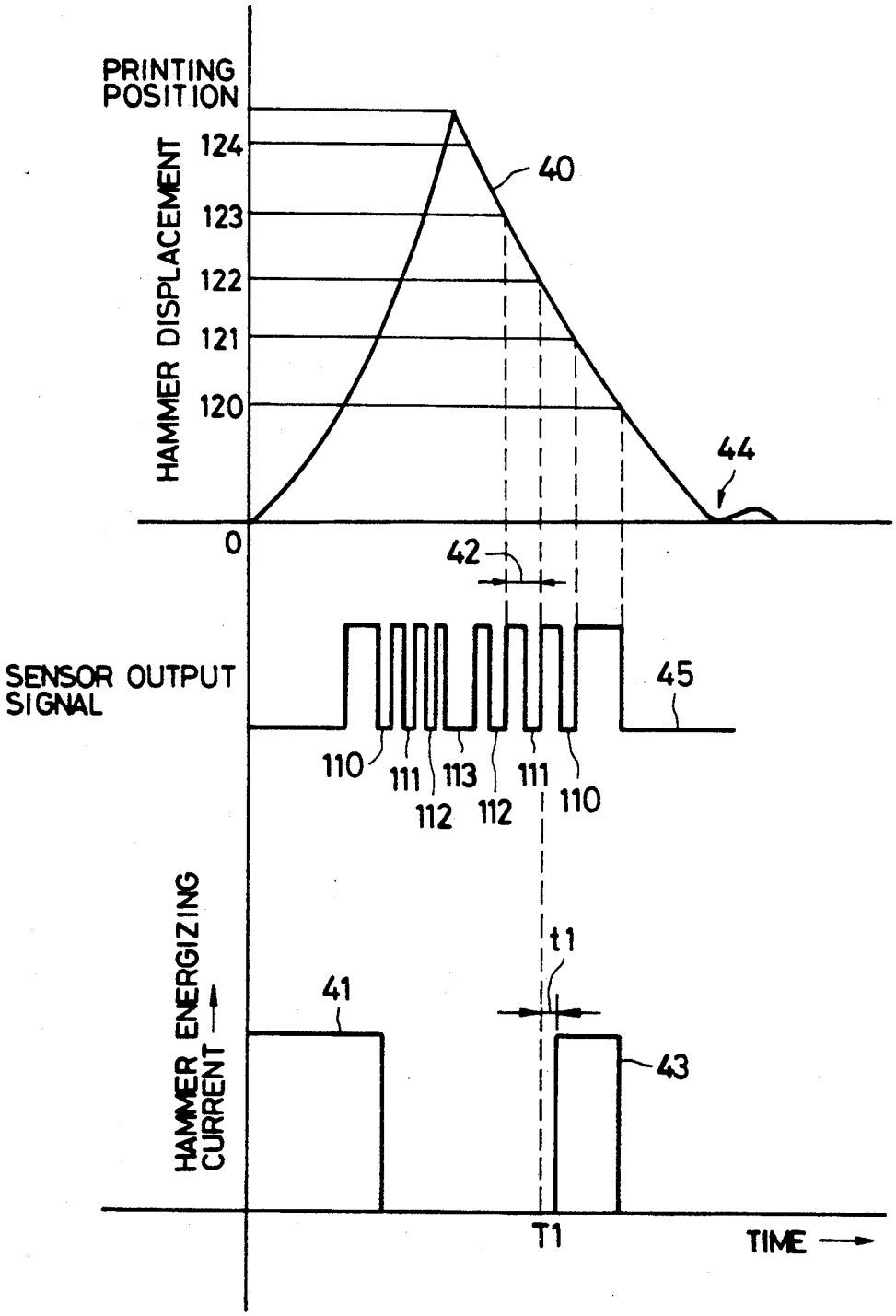
FIG. 4 is a timing chart of the hammer control in the present embodiment during the printing of a character of high printing pressure.
Figure 5:
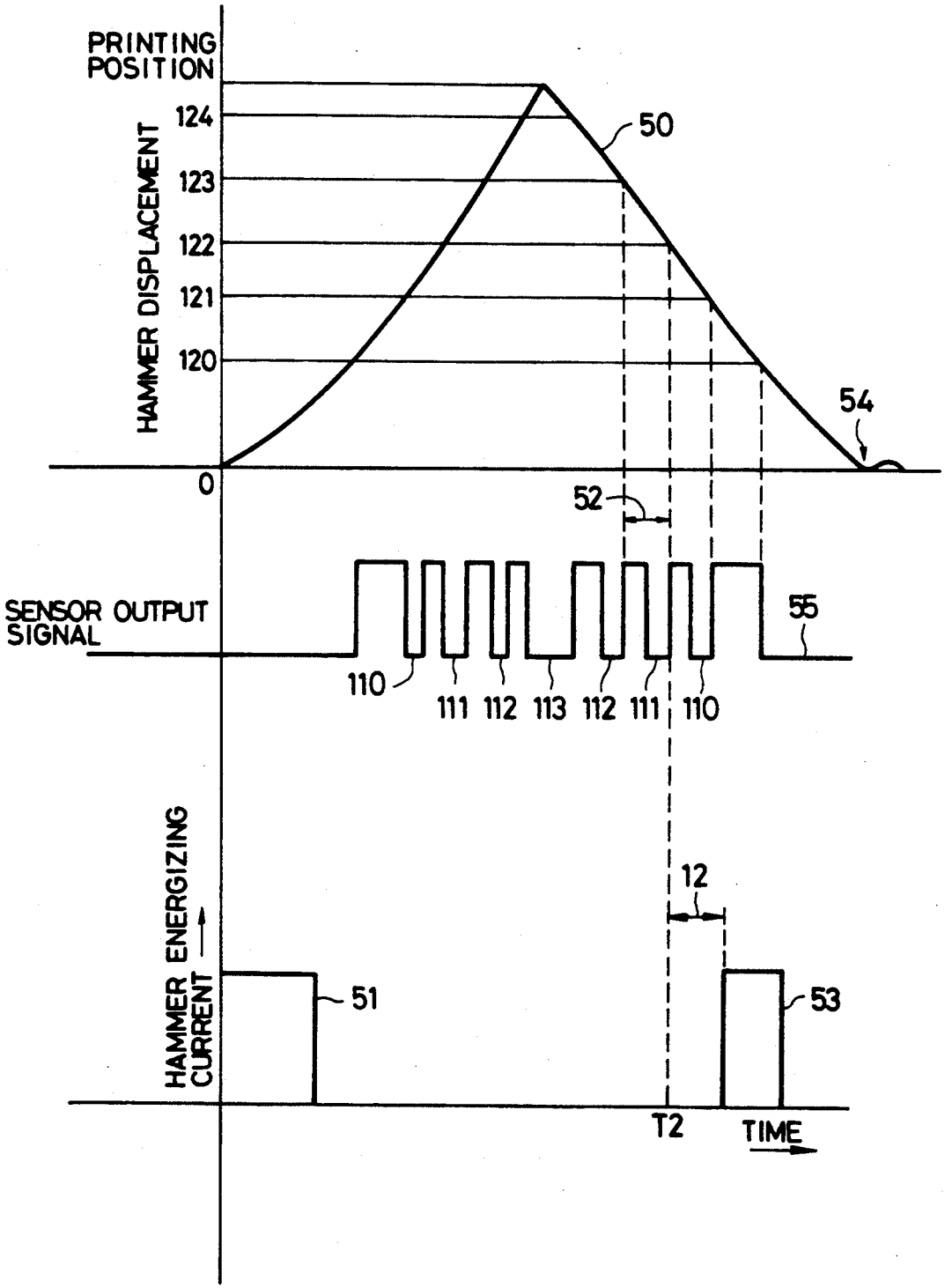
FIG. 5 is a timing chart of the hammer control in the present embodiment during the printing of a character of low printing pressure.

Description of the Decelerating Process of the Printing Hammer shown in FIGS. 4–6

The present embodiment adopts a method whereby the hammer 101 is re-energized correspondingly to the return speed thereof and the speed at which the hammer strikes against the stopper 8 - 1 is reduced. This operation will hereinafter be described in detail.

FIG. 4 shows the waveform when the speed of the hammer 101 printing a character of large printing area such as "M" as previously described is fast.

In FIG. 4, reference numeral 40 designates a waveform showing the spacing (displacement) between the stopper 8 - 1 and the hammer 101, and reference numerals 120–124, as in FIG. 1C, show the passage distances of the slit plate 11 relative to the sensor 2. Reference numeral 45 denotes the output signal of the sensor 12, and reference numerals 110–113 designate the output voltages of the sensor 12 1( corresponding to the positions of the slits 110–113.

When an instruction is given to print a character of large printing area such as "M", a large hammer energizing current is generated as indicated by 41 to energize the hammer 101. Thus, there is provided a steep rising waveform as shown by a waveform 40 and it is seen that the hammer 101 has been driven at a high speed. The return speed of the hammer 101 is found on the basis of the passage time 42 between the slits 112 and 111 (the passage time through the spacing between positions 122 and 123) when the hammer 101 returns after having arrived at the printing position.

When the edge of the slit 111 is detected at time T1, the hammer 101 is re-energized by a pulse 43 after time tl and the return speed of the hammer 101 is reduced. Thus, the shock with which the hammer 101 returns to the stopper 8 - 1 at 44 is reduced, whereby noise is reduced. This delay time tl is determined correspondingly to the return speed of the hammer 101.

FIG. 5 shows the waveform when a symbol of small printing area such as "." is printed, that is, when the speed of the hammer 101 is slow.

In FIG. 5, reference numeral 50 designates a waveform showing a variation in the stopper 8 - 1 and the hammer 101, and reference numerals 120–124, as in FIG. 4, denote the passage distances of the slit plate 11 relative to the sensor 12, and the waveform of the output signal of the sensor 12 corresponding thereto is designated by 55. As can be seen from the comparison with FIG. 4, when a printing instruction is given, the hammer 101 is driven by a pulse 51 which is smaller than the pulse 41. Thus, the hammer 101 is driven at a speed slower than in the case of FIG. 4. As in the case of FIG. 4, the hammer arrives at the printing position and the return speed thereof is found on the basis of the passage time 52 between the slits 112 and 111 (the passage time through the spacing between positions 122 and 123) when the hammer returns.

When as in the case of FIG. 4, the edge of the slit 111 is detected at time T2 in this manner, delay time t2 is found on the basis of the passage time 52 (return speed) and at a time delayed by t2 with respect to the time T2, the hammer 101 is reenergized by a pulse 53 and the return speed of the hammer 101 is reduced. Thus, the speed at which the hammer 101 returns to the stopper 8 - 1 at 54 can be reduced with good timing.

If design is made such that the return speed of the hammer 101 is detected in this manner and the time at which the re-energizing pulse is generated is changed corresponding thereto, better deceleration can be accomplished. This control method is shown in the flow chart of FIG. 6.

Figure 6A:
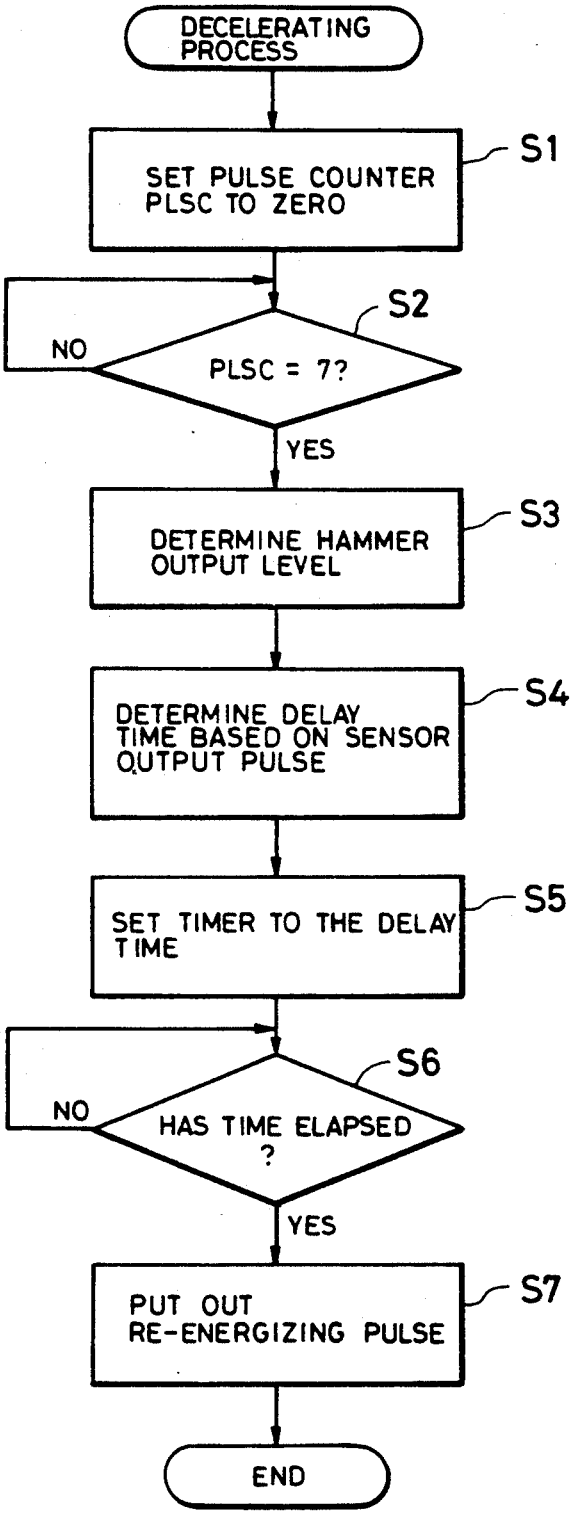
FIGS. 6A and 6B are flow charts showing the hammer re-energization control of the control unit.
Figure 6B:
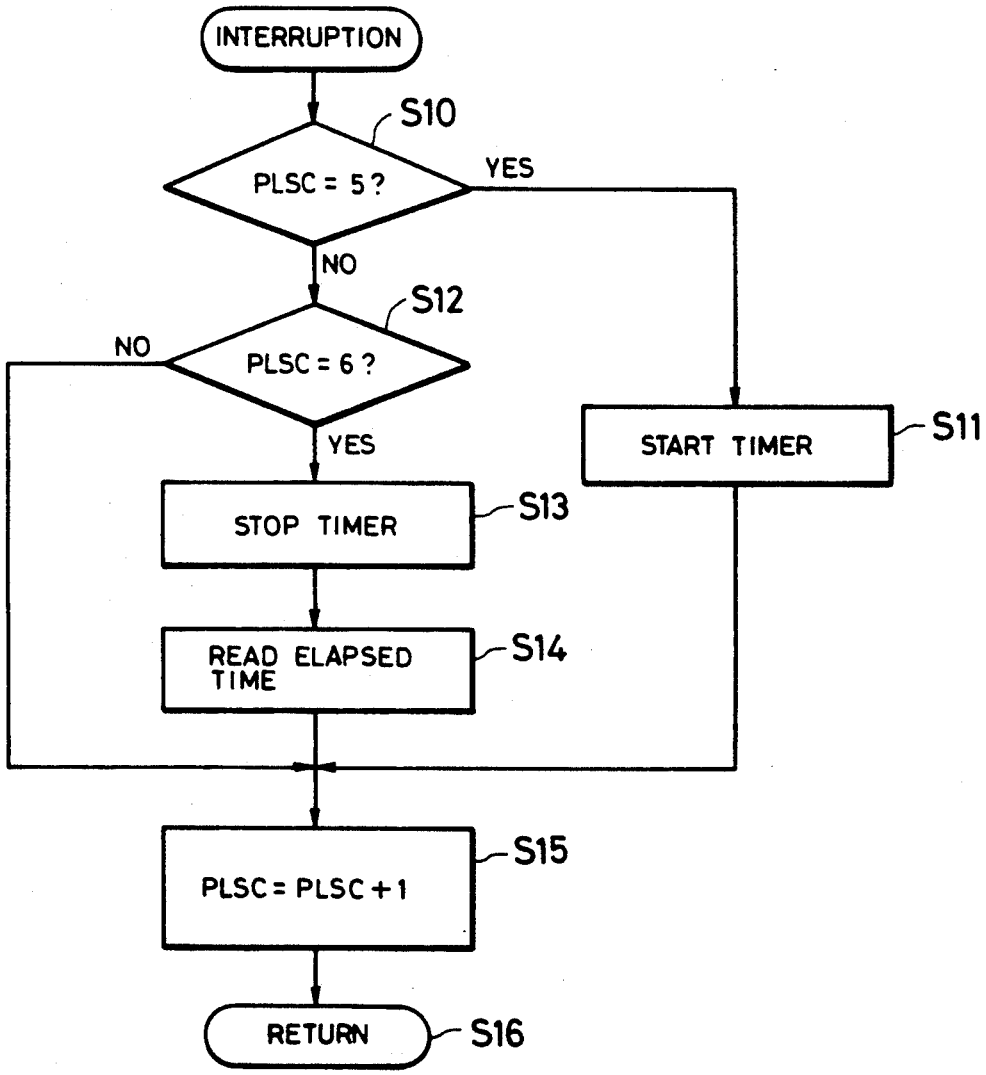
Figure 7A:
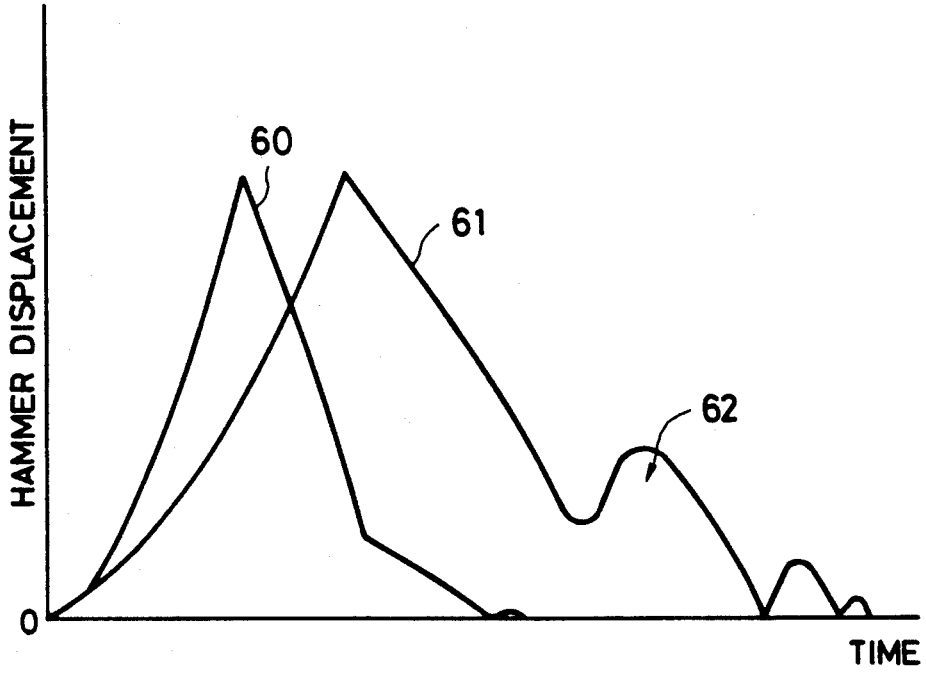
FIGS. 7A and 7B show the hammer displacement and the re-energization timing in an example of the prior art.
Figure 7B:
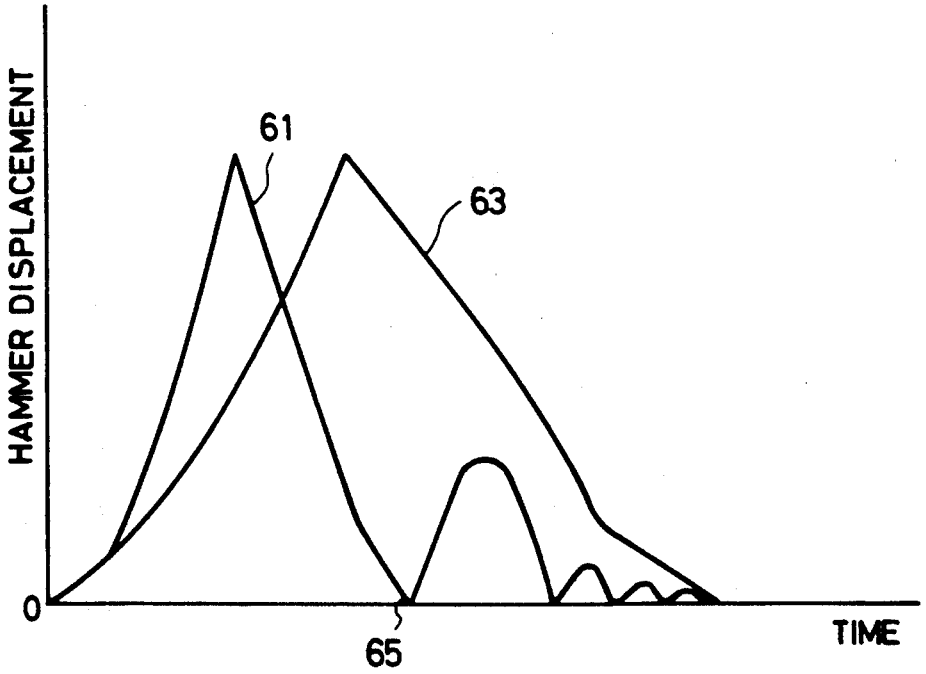

FIGS. 6A and 6B are the flow charts of the decelerating process for reducing the return speed of the hammer 101 when printing is executed.

First, at step S1, the pulse counter PLSC of RAM is set to "0". Subsequently, at step S2, whether the pulse counter PLSC has been set to "7" is checked up. This pulse counter PLSC is counted up by the interruption process of FIG. 6B in synchronism with the rising of the pulse from the signal shaping circuit 110. Each time the pulse signal from the sensor 12 rises, the interruption process program shown in the flow chart of FIG. 6B is executed, and first, at step S10, whether the pulse counter PLSC is set to "5" is checked up. Until the pulse counter PLSC is set to "5", nothing particular is done in this interruption routine, and at step S15, tl is only effected in the pulse counter PLSC and at step S16, return is only made to the main routine. When the pulse counter PLSC is set to "5", advance is made to step S11 and timer 109 is started, whereupon time counting is started.

This corresponds to the position of the displacement 123 of the hammer 101 when it returns which is shown in FIGS. 4 and 5, and means the instruction to start the measurement of time 42 or 52. When at step S12, the pulse counter PLSC assumes "6", that is, the displacement of the hammer 101 becomes 122, advance is made to step S13, where the timer 109 is stopped, and at step S14, the counted time th of the timer 109 is read. This corresponds to the times 42 and 52 of FIGS. 4 and 5. Subsequently, at step S15, t1 is effected in the pulse counter PLSC, and at step S16, return is made to the main routine.

When the above-described interruption routine is executed and the lapse time th of the timer 109 is read, advance is made to the step S3 of FIG. 6A, and on the basis of the value of the time th, the output level (the energizing pulse width) of the hammer 101 is determined with reference to the table or the like of the ROM of the controller 100. At step S4, on the basis of the time th, the delay time is determined with reference to the table as at step S3. This delay time corresponds to the time tl or t2 shown in FIGS. 4 and 5, and represents a delay time with respect to the time T1 or T2 of the re-energizing pulses 43 and 53. At step S5, the timer 109 is set to that delay time, and at step S6, whether that time has elapsed is checked up. When the lapse of the delay time is confirmed by the output of the timer 109, re-energizing pulse is put out at step S7 and the return speed of the hammer 101 is reduced.

As described above, according to the present embodiment, the hammer 101 is endowed with a delay time corresponding to the return speed from a predetermined position in conformity with the return speed of the hammer 101 and re-energization of the hammer is effected for deceleration, whereby there is obtained a smooth deceleration effect corresponding to the return speed of the hammer 101.

The detection of the pulse output by the sensor output signal in the present embodiment may be effected at the rising or the falling of the pulse, and the counting of the delay time may be accomplished not only by the timer, but also by counting the pulse number from the sensor.

As described above, according to the present invention, the speed of the hammer during its return can be reduced in conformity with the speed of the hammer and therefore, deceleration can be achieved efficiently and smoothly and impact sound can be weakened.

Another embodiment of the present invention will now be described with reference to FIGS. 8 to 11. In the present embodiment, as compared with the previously described embodiment, the value of the hammer braking current, in addition to the hammer braking timing, can be varied in conformity with the detected speed of the hammer.

Figure 8:
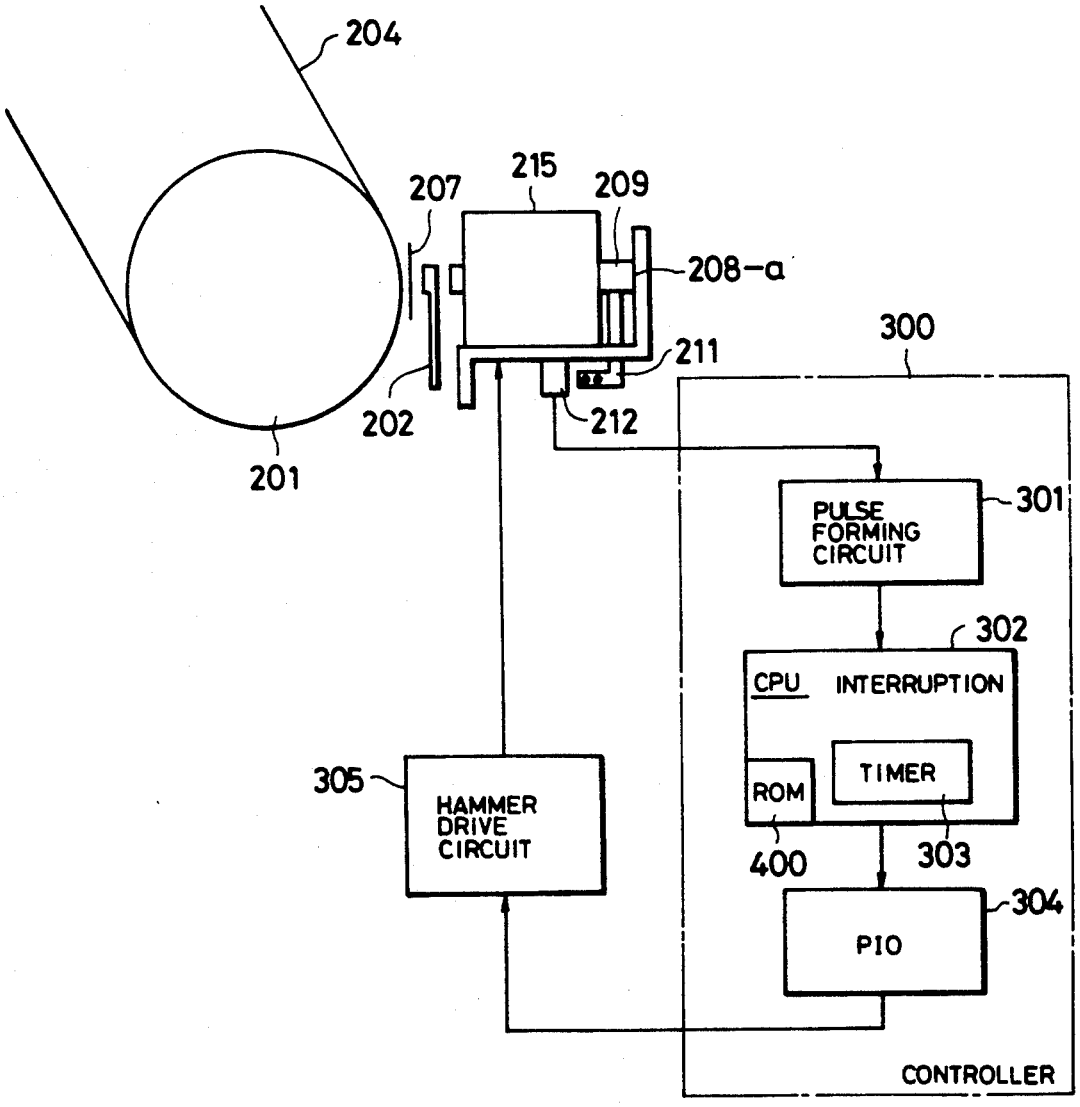
FIG. 8 is a block diagram showing the construction of a recording apparatus according to another embodiment of the present invention.

FIG. 8 is a block diagram showing the construction of a recording apparatus according to another embodiment of the present invention. In FIG. 8, reference numeral 300 designates a printing controller including a pulse forming circuit 301 for amplifying the detection signal from a sensor 212 and forming a pulse, a central processing unit (CPU) 302 for detecting the return speed or the like of a printing hammer 209 in response to the generation of a pulse signal by the pulse forming circuit and finding a solenoid drive starting position, a driving current, etc. for effecting appropriate hammer braking on the basis of said detected speed, and effecting the drive control of the printing hammer in accordance with these, and a peripheral IO circuit 304 for sending the control signal of the CPU 302 to the outside. Reference numeral 305 denotes a driver circuit for driving the printing hammer.

Operation will now be described.

Figure 10A:
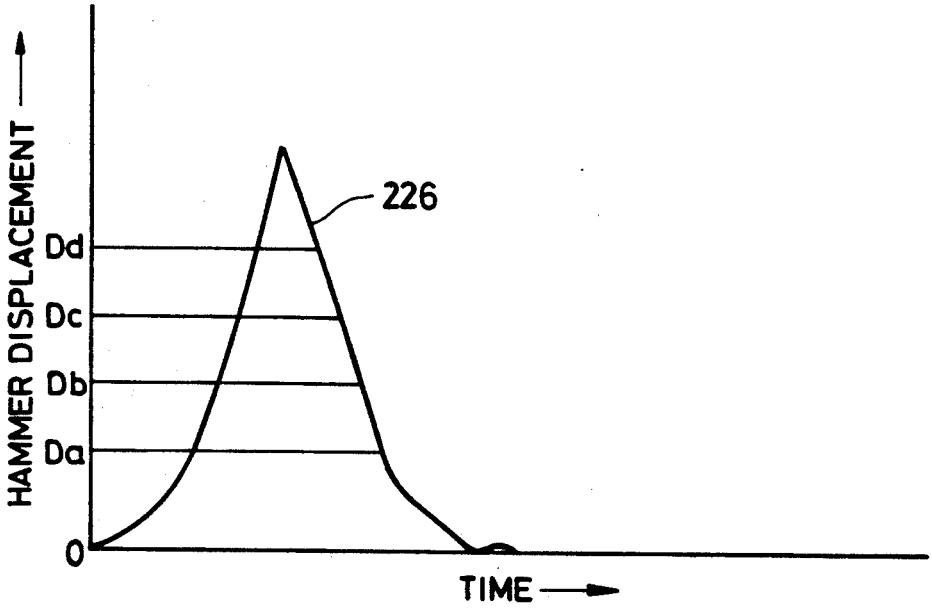
FIGS. 10A-10C show the hammer energizing current control when the return speed of the printing hammer is fast as when a character "M" is printed.
Figure 10B:
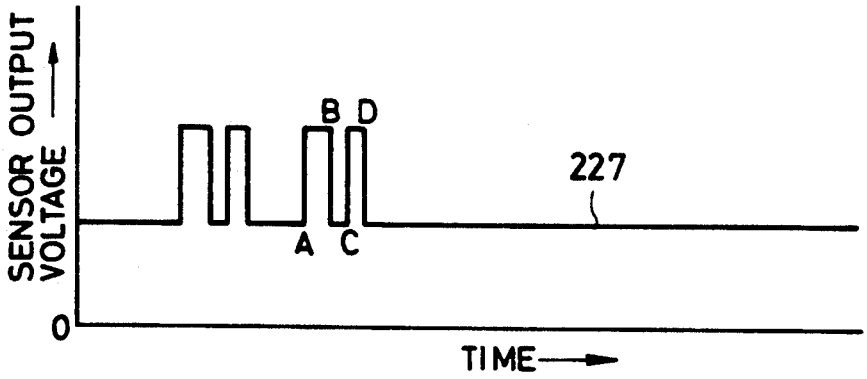
Figure 10C:
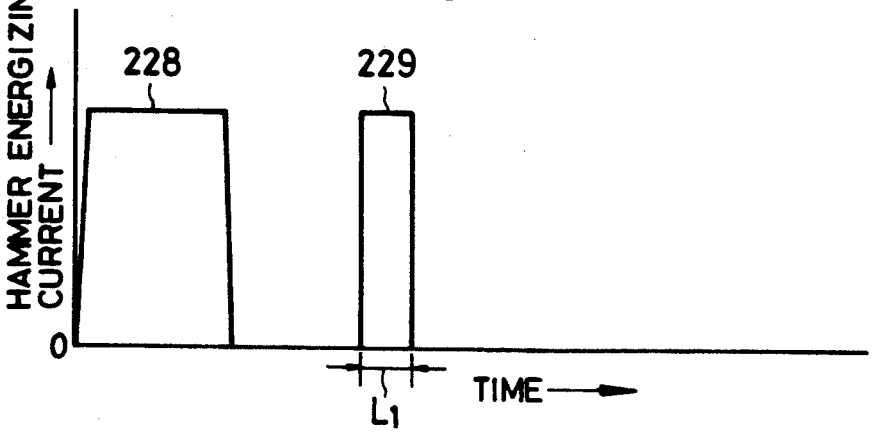

FIGS. 10A–10C show the hammer energizing current control when the return speed of the printing hammer 209 is fast as when a character such as "M" is to be printed, and in this case, after the return speed is detected between B and D, re-energization is immediately effected by a pulse 229 so that smooth deceleration is accomplished as indicated by a curve 226.

Figure 11A:
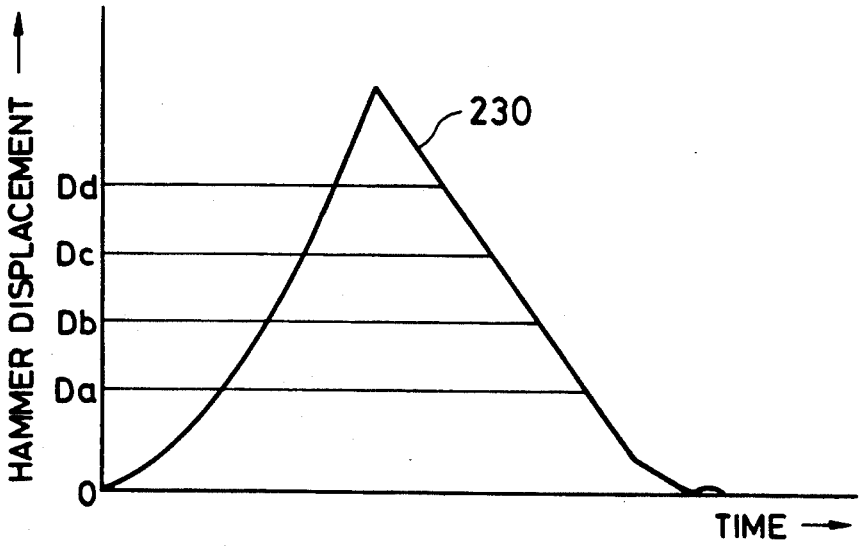
FIGS. 11A-11C show the hammer energizing current control when the return speed of the printing hammer is slow as when a symbol "." is printed.
Figure 11B:
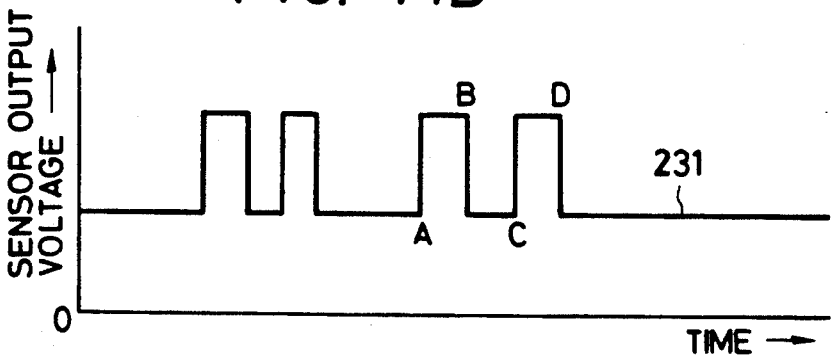
Figure 11C:
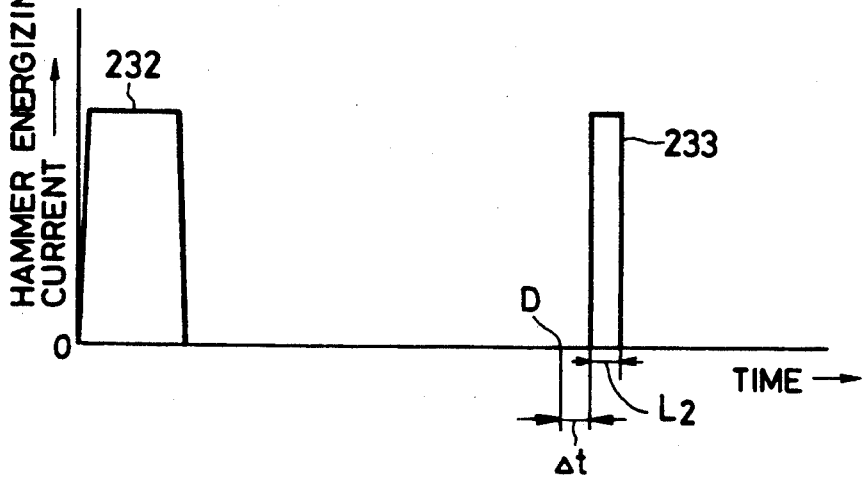

FIGS. 11A–11C show the hammer energizing current control when the return speed of the printing hammer 209 is slow as when a symbol such as "." is to be printed. If re-energization is effected simultaneously with the speed detection between B and D as previously described also when a character of small printing area like a symbol "." is printed, brake will act at a location far from a stopper 208-a and a sufficient effect will not be obtained So, in this case, after the speed is detected between B and D as shown in FIG. 11*c*, that is, after a point D is detected, the time when a pulse 233 is generated is delayed by a predetermined time $\Delta t$. If this is done, the printing hammer 209 will come closer to the stopper 208-a during the delay time $\Delta t$ and deceleration will be started in an appropriate position and thus, smooth deceleration will be accomplished as indicated by a curve 230 in FIG. 11A.

Figure 9A:
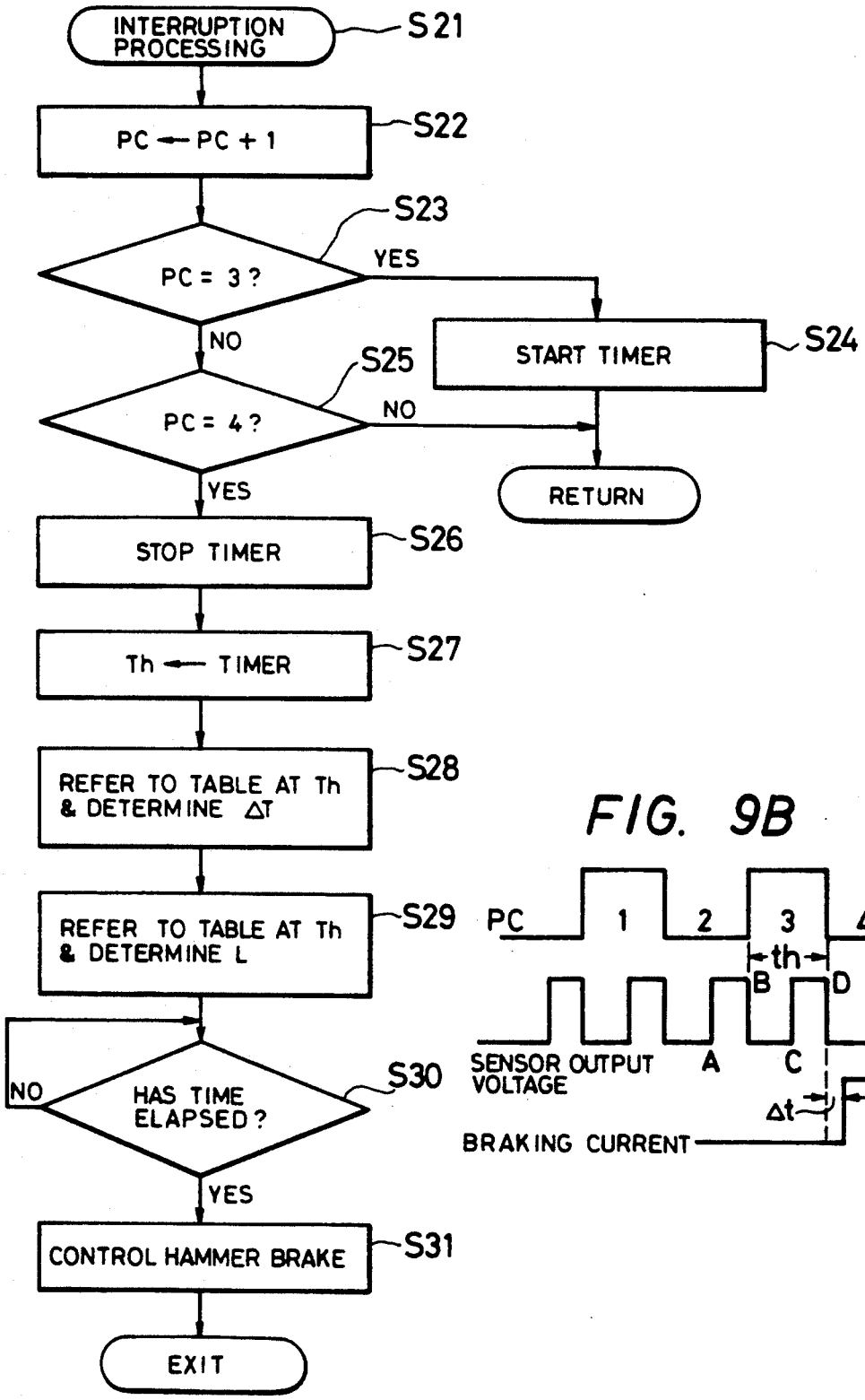
FIG. 9A is a flow chart showing the brake control procedure in said another embodiment.
Figure 9B:
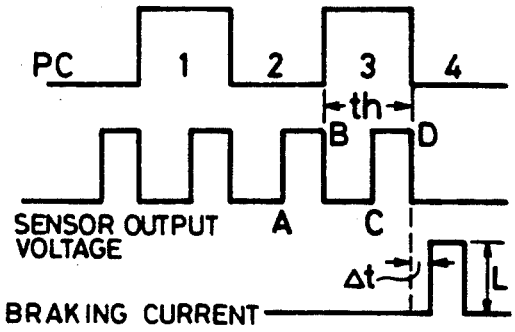
FIG. 9B is a timing chart of the brake operation.

FIG. 9A is a flow chart showing the brake control procedure in the present embodiment, and FIG. 9B is a timing chart of braking operation. When a pulse is generated in the output of the pulse forming circuit 301, interruption input is effected at step S21. At step S22, +1 is effected on a pulse counter (PC) in the CPU 302. Thus, the pulse counter PC counts the frequency of generation of the sensor output pulse in the reciprocal movement of the printing hammer, as shown in FIG. 9B. At step S23, whether PC=3 is discriminated. If PC=3, advance is made to step S24, where the timer 303 is started. This is for measuring the time between B and D. Unless PC=3, advance is made to step S25, where whether PC=4 is discriminated. Unless PC=4, return is made. If PC=4, advance is made to step S26, where the timer 303 is stopped. At step S27, the content of the timer 303 is held in a register Th in the CPU 302. At step S28, by the content of the register Th, the corresponding delay time At is read out from a plurality of delay times with reference to the ROM table 400 in the CPU 302. Further, at step S29, likewise by the content of the register Th, an optimum driving current value L is read out from a plurality of driving current values with reference to the ROM table 400. In this manner, at step S30, the lapse of the delay time Δt is waited for. This can be accomplished by the CPU 302 looping a predetermined routine for the time Δt. At step S31, second driving pulse control (braking current control) as shown in FIG. 9B is effected to thereby accomplish optimum braking.

What we claim is

1. An impact type recording apparatus platen means for supporting a recording medium;

a character wheel having characters;

hammer means guided reciprocatingly between an impacting position for impacting said platen means through a character of said character wheel and a retracted position spaced apart from said platen means;

energizing means producing a force for biasing said hammer means from said retracted position toward said impacting position;

means for detecting a return speed at which said hammer means returns along a return path to said retracted position from said impacting position; and drive control means for applying a braking force of only one pulse to said hammer means at a poin along the return path when said hammer means is moved from said impacting position to said retracted position, said drive control means having means for adjusting the timing for initiating an operation of said drive control means in response to a result of the detection by said detecting means, wherein operation of said drive control means is initiated at said point along the return path as determined as a function of the detected return speed.

2. An apparatus according to claim 1, wherein said energizing means differing in its biasing force in accordance with an area of each character of said character wheel, the biasing force of said biasing means is large when an area of a character to be printed is large and is small when an area of a character to be printed is small, and speed of said hammer means is high when the biasing foce is high and is low when the biasing force is low.

3. An apparatus according to claim 1, wherein said adjusting means advances the timing for initiating the operation of said drive control means when the speed of the hammer means is high, and delays said timing when the speed of the hammer means is low.

4. An impact type recording apparatus according to claim 1, wherein both said energizing means and said drive control means utilize a common hammer driving circuit.

5. An apparatus according to claim 1, further comprising a timer provided on said return speed detecting means, wherein said drive control means comprises a central processing unit and a read only memory having a table stored therein, wherein information from said timer is transmitted to said central processing unit of said drive control means and wherein said central processing unit controls a driving timing for applying the braking force in accordance with the table stored in said read only memory.

6. An apparatus according to claim 1, further comprising a timer provided on said return speed detecting means, wherein said drive control means comprises a central processing unit and a read only memory having a table stored therein, wherein information from said timer is transmitted to said central processing unit of said drive control means and wherein said central processing unit controls a driving time period for applying the braking force in accordance with the table stored in said read only memory.

7. An impact type recording apparatus for recording on a recording medium, said apparatus comprising:

an image holding member;

impacting means for impacting said image holding member to the recording medium to record on the recording medium;

return speed detecting means for detecting a speed at which said impacting means returns along a return path to an initial position after said image holding member impacts the recording medium; and controlling means for controlling a timing for applying a braking force of only one pulse to said impacting means at a point along the return path when said impacting means returns to the initial position in accordance with detection results produced by said return speed detecting means, wherein said point along the return path is determined as a function of the detected return speed.

8. An apparatus according to claim 7, wherein said impacting means impacts said image holding member in a state that the recording medium intervenes between a platen and an ink ribbon.

9. An apparatus according to claim 7, wherein said impacting means comprises a yoke, a hammer member, a coil unit and a compression spring, and wherein said hammber member projects to impact said image holding member.

10. An apparatus according to claim 7, wherein said image holding member has a plurality of character members and a character wheel comprising said character members.

11. An apparatus according to claim 7, wherein said return speed detecting means detects the time interval for said impacting means to return from a recording position to an initial position.

12. An apparatus according to claim 7, wherein said controlling means comprises a central processing unit, a random access memory, and a read only memory which are connected to said central processing unit.

13. An apparatus according to claim 7, further comprising a timer provided on said return speed detecting means, wherein said controlling means comprises a central processing unit and a read only memory having a table stored therein, wherein information from said timer is transmitted to said central processing unit of said controlling means and wherein said central processing unit controls a driving timing for applying the braking force in accordance with the table stored in said read only memory.

14. An apparatus according to claim 7, wherein said impacting means further comprises a hammer, wherein said apparatus further comprises a stopper for stopping said hammer.

15. An apparatus according to claim 7, wherein said image holding member comprises a character wheel having a plurality of character members, wherein said impacting means comprises a hammer means projecting to impact a character member of said character wheel selected from said plurality of character members, wherein said hammer means changes speed when said hammer means projects in accordance with the size of a selected character means.

16. An apparatus according to claim 8, wherein said impacting means impacts said image holding member in a state that the recording medium intervenes between a platen and an ink ribbon.

17. An apparatus according to claim 8, wherein said impacting means comprises a yoke, a hammer member, a coil unit and a compression spring, and wherein said hammber member projects to impact said image holding member.

18. An apparatus according to claim 8, wherein said image holding member has a plurality of character members and a character wheel comprising said character members.

19. An apparatus according to claim 8, wherein said return speed detecting means detects the time interval for said impacting means to return from ar ecording position to an initial position.

20. An apparatus according to claim 8, wherein said controlling means comprises a central processing unit, a random access memory, and a read only memory which are connected to said central processing unit.

21. An apparatus according to claim 8, further comprising a timer provided on said return speed detecting means, wherein said controlling means comprises a central processing unit and a read only memory having a table stored therein, wherein information from said timer is transmitted to said central processing unit of said controlling means and wherein said central processing unit controls a driving timing for applying the braking force in accordance with the table stored in said ready only memory.

22. An apparatus according to claim 8, wherein said impacting means further comprises a hammer, wherein said apparatus further comprises a stopper for stopping said hammer.

23. An apparatus according to claim 7, wherein said image holding member comprises a character wheel having a plurality of character members, wherein said impacting means comprises a hammer means projecting to impact a character member of said character wheel selected from said plurality of character means, wherein said hammer means changes speed when said hammer means projects in accordance with the size of a selected character member.

24. An impact type recording apparatus according to claim 7, wherein both said impacting means and said controlling means utilize a common driving circuit.

25. An apparatus according to claim 7, further comprising a timer provided on said return speed detecting means, wherein said controlling means comprises a central processing unit and a read only memory having a table stored therein, wherein information from said timer is transmitted to said central processing unit of said controlling means and wherein said central processing unit controls a driving time period for applying the braking force in accordance with the table stored in said read only memory.

26. An impact type recording apparatus for recording on a recording medium, said apparatus comprising:

an image holding member;

impacting means for impacting said image holding member to the recording medium to record on the recording medium;

return speed detecting means for detecting a speed at which said impacting means returns along a return path to an initial position after said image holding member impacts the recording medium;

braking means for applying a braking force of only one pulse to said impacting means at a point along the return path to decrease the return speed of said impacting means when said impacting means returns to said initial position; and controlling means for controlling a timing when said braking means starts to apply said braking force in accordance with detection results produced by said return speed detecting means, wherein said point along the return path is determined as a function of the detected return speed.

27. An impact type recording apparatus according to claim 26, wherein both said impacting means and said braking means utilize a common driving circuit.

28. An apparatus according to claim 26, further comprising a timer provided on said return speed detecting means, wherein said controlling means comprises a central processing unit and a read only memory having a table stored therein, wherein information from said timer is transmitted to said central processing unit of said controlling means and wherein said central processing unit controls a driving timing for applying the braking force in accordance with the table stored in said read only memory.

29. An apparatus according to claim 26, further comprising a timer provided on said return speed detecting means, wherein said controlling means comprises a central processing unit and a read only memory having a table stored therein, wherein information from said timer is transmitted to said central processing unit of said controlling means and wherein said central processing unit controls a driving time period for applying the braking force in accordance with the table stored in said read only memory.

30. An impact type recording apparatus for recording on a recording medium, said apparatus comprising:

a platen;

a character wheel having a plurality of character means;

hammer means for impacting said character member selected from said plurality of character members of said character wheel to said platen through the recording medium and an ink ribbon;

return speed detecting means for detecting a speed at which said hammer means returns along a return path to an initial position after said hammer means impacts said platen;

braking means for applying a braking force of only one pulse to said hammer means at a point along the return path to decrease the return speed of said hammer means when said hammer means returns to said initial position; and controlling means for controlling a timing when said braking means starts to apply said braking force to said hammer means in accordance with detection results produced by said return speed detecting means, wherein said point along the return path is determined as a function of the detected return speed.

31. An apparatus according to claim 30, wherein said hammer means changes speed when said hammer means projects in accordance with the size of said selected character member.

32. An apparatus according to claim 30, further comprising a timer provided on said return speed detecting means, wherein said controlling means comprises a central processing unit and a read only memory having a table stored therein, wherein information from said timer is transmitted to said central processing unit of said controlling means and wherein said central processing unit controls a driving timing for applying the braking force in accordance with the table stored in said read only memory.

33. An apparatus according to claim 30, further comprising a timer provided on said return speed detecting means, wherein said controlling means comprises a central processing unit and a read only memory having a table stored therein, wherein information from said timer is transmitted to said central processing unit of said controlling means and wherein said central processing unit controls a driving time period for applying the braking force in accordance with the table stored in said read only memory.

34. An impact type recording apparatus for recording on a recording medium, said apparatus comprising:

a platen;

a carriage movable along said platen;

a hammer provided on said carriage;

driving means for causing said hammer to project to said platen so as to record on the recording medium;

detecting means for detecting a return speed at which said hammer returns from said platen along a return path to an initial position after said hammer impacts said platen;

braking means for applying a braking force of only one pulse to said hammer at a point along the return path to decrease the return speed of said hammer when said hammer returns to said initial position; and controlling means for controlling the timing when said braking means starts to apply said braking force to said hammer in accordance with detection results produced by said detecting means, wherein said point along the return path is determined as a function of the detected return speed.

35. An apparatus according to claim 34, further comprising a character wheel comprising plurality of character members, wherein said hammer impacts a selected character member from said plurality of character members of said character wheel, wherein said hammer changes speed when said hammer projects in accordance with the size of a selected character member.

36. An impact type recording apparatus according to claim 34, wherein both said drive means and said braking means utilize a common driving circuit.

37. An apparatus according to claim 34, further comprising a timer provided on said return speed detecting means, wherein said controlling means comprises a central processing unit and a read only memory having a table stored therein, wherein information from said timer is transmitted to said central processing unit of said controlling means and wherein said central processing unit controls a driving timing for applying the braking force in accordance with the table stored in said read only memory.

38. An apparatus according to claim34, further comprising a timer provided on said return speed detecting means, wherein said controlling means comprises a central processing unit and a read only memory having a table stored therein, wherein information from said timer is transmitted to said central processing unit of said controlling means and wherein said central processing unit controls a driving time period for applying the braking force in accordance with the table stored in said read only memory.

39. An impact type recording apparatus for recording on a recording medium, said apparatus comprising:

a character member;

hammer means for impacting said character member to the recording medium to record on the recording medium; and control means for controlling a timing for applying a braking force of only one pulse to said hammer means at a point along the return path when said hammer means returns to an initial position in accordance with detection results of a return speed of said hammer means to said initial position after said hammer means impacts said character member, wherein said point along the return path is determined as a function of the detected return speed.

40. An impact type recording apparatus according to claim 39, wherein said hammer means impacts said character member through an ink ribbon between said character member and the recording medium.

41. An impact type recording apparatus according to claim 39, wherein said control means has a CPU, RAM and ROM connected to said CPU.

42. An apparatus according to claim 39, further comprising a timer provided on said cotnrol means, wherein said control means comprises a central processing unit and a read only memory having a table stored therein, wherein information from said timer is transmitted to said central processing unit of said control means and wherein said central processing unit controls a driving timing for applying the braking force in accordance with the table stored in said read only memory.

43. An apparatus according to claim 39, further comprising a timer provided on said control means, wherein said control means comprises a central processing unit and a read only memory having a table stored therein, wherein information from said timer is transmitted to said central processing unit of said control means and wherein said central processing unit controls a driving time period for applying the braking force in accordance with the table stored in said read only memory.

* * * * *

UNITED STATES PATENT AND TRADEMARK OFFICE

CERTIFICATE OF CORRECTION

PATENT NO. : 5,147,142

DATED : September 15, 1992

INVENTOR(S) : Nobuo Shibazaki, et al.

It is certified that error appears in the above-identified patent and that said Letters Patent is hereby corrected as shown below:

ON THE TITLE PAGE,
[54] TITLE:

"APPARTUS" should read --APPARATUS--.

COLUMN 1:

Line 1, "APPARTUS" should read --APPARATUS--.
Line 8, "07/-094,894" should read --07/094,894--.
Line 53, "completed" should read --completed when--.

COLUMN 3:

Line 18, "Fig. 37" should read --Fig. 3--.

COLUMN 4:

Line 30, "1(" should be deleted.

COLUMN 7:

Line 27, "apparatus" should read --apparatus including:--.
Line 43, "poin" should read --point--.

COLUMN 8:

Line 48, "hammber" should read --hammer--.

UNITED STATES PATENT AND TRADEMARK OFFICE

CERTIFICATE OF CORRECTION

PATENT NO. :5,147,142

DATED :September 15, 1992

INVENTOR(S) :Nobuo Shibazaki, et al.

It is certified that error appears in the above-identified patent and that said Letters Patent is hereby corrected as shown below:

COLUMN 9:

Line 24, "hammber" should read --hammer--.
Line 32, "ar ecording" should read --a recording--.
Line 47, "ready" should read --read--.
Line 57, "means," should read --members,--.

COLUMN 11:

Line 59, "comprising" should read --comprising a--.

COLUMN 12:

Line 47, "cotnrol" should read --control--.

Signed and Sealed this

Twenty-third Day of March, 1993

*Attest:*

STEPHEN G. KUNIN

*Attesting Officer*

*Acting Commissioner of Patents and Trademarks*